US009076606B2

(12) United States Patent
Schneider et al.

(10) Patent No.: US 9,076,606 B2
(45) Date of Patent: Jul. 7, 2015

(54) MAGNET ARRANGEMENT FOR A LOW-VOLTAGE CIRCUIT-BREAKER

(71) Applicant: ABB Schweiz AG, Baden (CH)

(72) Inventors: Gerhard Schneider, Blumberg (DE); Thomas Wulf, Überlingen (DE)

(73) Assignee: ABB SCHWEIZ AG, Baden (CH)

( * ) Notice: Subject to any disclaimer, the term of this patent is extended or adjusted under 35 U.S.C. 154(b) by 185 days.

(21) Appl. No.: 13/669,152

(22) Filed: Nov. 5, 2012

(65) Prior Publication Data

US 2013/0112656 A1 May 9, 2013

(30) Foreign Application Priority Data

Nov. 4, 2011 (EP) ..... 11187846

(51) Int. Cl.

| | |
|---|---|
| ***H01H 33/30*** | (2006.01) |
| ***H01H 33/40*** | (2006.01) |
| ***H01H 33/42*** | (2006.01) |
| ***H01H 3/00*** | (2006.01) |
| ***H01H 9/44*** | (2006.01) |

(52) U.S. Cl.

CPC ..... *H01H 9/443* (2013.01)

(58) Field of Classification Search

CPC ..... H01H 3/00; H01H 33/42; H01H 33/30; H01H 33/40; H01H 33/09

See application file for complete search history.

(56) References Cited

U.S. PATENT DOCUMENTS

| | | | | |
|---|---|---|---|---|
| 4,395,606 | A * | 7/1983 | Zaffrann et al. | 218/149 |
| 4,962,406 | A * | 10/1990 | Walker et al. | 335/201 |
| 7,081,596 | B2 * | 7/2006 | Schneider et al. | 218/22 |
| 7,679,020 | B2 * | 3/2010 | Schulz et al. | 218/26 |
| 7,839,243 | B1 * | 11/2010 | Chen et al. | 335/201 |

(Continued)

FOREIGN PATENT DOCUMENTS

| | | |
|---|---|---|
| DE | 33 47 042 A1 | 7/1985 |
| EP | 1 548 773 A1 | 3/2008 |

(Continued)

OTHER PUBLICATIONS

European Search Report for EP 11187846 dated Mar. 14, 2012.

*Primary Examiner* — Renee S Luebke

*Assistant Examiner* — William Bolton

(74) *Attorney, Agent, or Firm* — Buchanan Ingersoll & Rooney PC

(57) ABSTRACT

An exemplary magnet arrangement improves the running characteristics of a switching arc generated upon the interruption of a current circuit in a pre-chamber of a low-voltage circuit-breaker, in which the switching arc is directed between two electric arc running rails. The exemplary arrangement includes an open magnetic circuit having a magnetic material and at least one permanent magnet that delivers magnetic flux to the magnetic circuit, with magnetic induction generated in a vicinity of the pre-chamber acting upon the switching arc. The magnetic material can be configured as a U-section sheet metal plate which extends along the length of the pre-chamber and includes a material recess which extends through this pre-chamber metal sheet and is arranged to contain the at least one permanent magnet. The exemplary arrangement is of a simple construction and permits adjustment of magnetic induction acting in the pre-chamber of the low-voltage circuit-breaker.

21 Claims, 3 Drawing Sheets

(56) References Cited

U.S. PATENT DOCUMENTS

| | | | | |
|---|---|---|---|---|
| 8,735,758 | B2 * | 5/2014 | Chen et al. | 218/154 |
| 2005/0150870 | A1 | 7/2005 | Schneider et al. | |
| 2008/0296264 | A1 | 12/2008 | Schulz et al. | |
| 2010/0126966 | A1 | 5/2010 | Domejean et al. | |

FOREIGN PATENT DOCUMENTS

| | | | |
|---|---|---|---|
| EP | 2 189 996 | A1 | 5/2010 |
| EP | 1 998 350 | B1 | 6/2011 |
| FR | 2622736 | * | 10/1987 |
| FR | 2 622 736 | A1 | 5/1989 |

* cited by examiner

MAGNET ARRANGEMENT FOR A LOW-VOLTAGE CIRCUIT-BREAKER

RELATED APPLICATION

This application claims priority under 35 U.S.C. §119 to European Patent Application No. 11187846.8 filed in Europe on Nov. 4, 2011, the entire content of which is hereby incorporated by reference in its entirety.

FIELD

The present disclosure relates to a magnet arrangement and to a low-voltage circuit-breaker incorporating a magnet arrangement of this type.

BACKGROUND INFORMATION

In low-voltage circuit-breakers, known magnet arrangements are used in a pre-chamber, arranged between a breakpoint and an arc-extinguishing chamber, as a means of improving the running characteristics of the switching arc associated with the interruption of a short-circuit current or overcurrent. The effective magnetic induction applied to the switching arc can be dictated by the geometry, the polarity, the constituent magnetic material and the magnetization of the permanent magnet in an open magnetic circuit.

A magnetic arrangement of the above-mentioned type is described in EP 1 998 350 B1. This magnet arrangement includes two iron plates, which are laterally adjacent to a pre-chamber in a low-voltage circuit-breaker, and a permanent magnet for the delivery of the magnetic flux to the two iron plates. The resulting open-circuit magnetic induction in the pre-chamber between the two iron plates is used to improve the running characteristics of a switching arc which is generated when a direct current is interrupted.

An arc-extinguishing installation for a low-voltage circuit-breaker with a double break function is also known from EP 1 548 773 B1, in which the running characteristics of two switching arcs which are generated when an alternating current is interrupted, and which pass through one of two pre-chambers respectively during the interruption process, are improved by means of two casings of a magnetic material, one of which is associated with each of the two pre-chambers respectively. Each casing is provided with a U-section sheet, surrounds its associated pre-chamber in the lateral direction and is adjacent to one of the electric arc running rails for the direction of the lower root point of the switching arc.

SUMMARY

An exemplary magnet arrangement for improving running characteristics of a switching arc is disclosed, the switching arc being generated upon an interruption of a current circuit in a pre-chamber of a low-voltage circuit-breaker, in which the switching arc is directed between two electric arc running rails, the magnet arrangement comprising: an open magnetic circuit comprised of a magnetic material; and at least one permanent magnet that delivers a magnetic flux to the magnetic circuit and generates magnetic induction in a vicinity of the pre-chamber that acts upon the switching arc, wherein the magnetic material is configured as a U-section metal sheet which extends along the length of the pre-chamber, the U-section metal including a material recess that extends through the pre-chamber metal sheet and contains the at least one permanent magnet.

An exemplary low-voltage circuit-breaker is disclosed comprising: a pre-chamber; electric arc running rails, wherein a switching arc is directed the electric arc running rails; and a magnet arrangement, wherein the magnet arrangement comprises: an open magnetic circuit comprised of a magnetic material; and at least one permanent magnet that delivers a magnetic flux to the magnetic circuit and generates magnetic induction in a vicinity of the pre-chamber that acts upon the switching arc, wherein the magnetic material is configured as a U-section metal sheet which extends along the length of the pre-chamber, the U-section metal including a material recess that extends through the pre-chamber metal sheet and contains the at least one permanent magnet.

BRIEF DESCRIPTION OF THE DRAWINGS

The disclosure is described in greater detail below, with reference to the following isometric drawings, in which.

DETAILED DESCRIPTION

Figure 1:
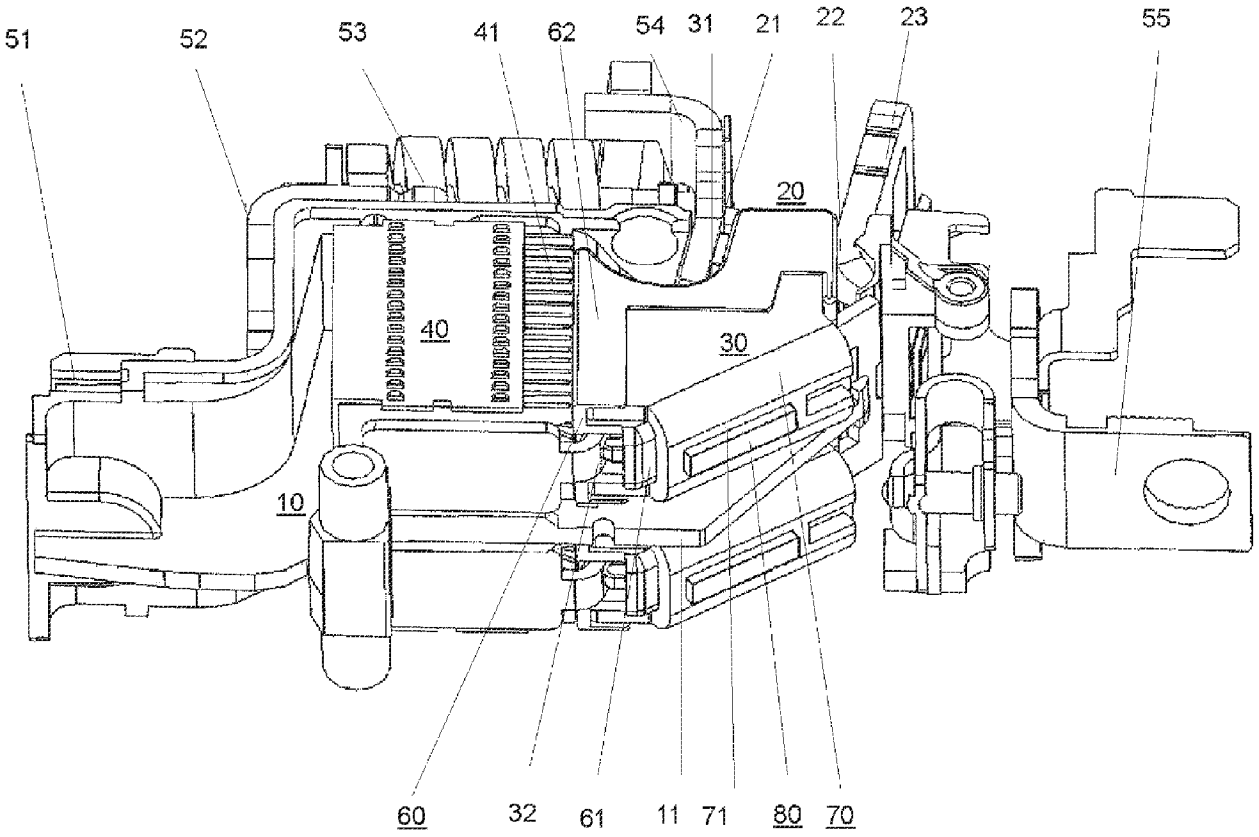
FIG. 1 shows an arc-extinguishing installation of a low-voltage circuit-breaker, incorporating a magnet arrangement in accordance with an exemplary embodiment of the present disclosure.

Exemplary embodiments of the present disclosure provides a magnet arrangement of the type described above for a low-voltage circuit-breaker, which is distinguished by its simple construction and its facility for straightforward adjustment of magnetic induction, and the simultaneous disclosure of a low-voltage circuit-breaker provided with a magnet arrangement of this type.

According to an exemplary embodiment the present disclosure, a magnet arrangement improves the running characteristics of a switching arc generated upon the interruption of a current circuit in a pre-chamber of a low-voltage circuit-breaker, in which the switching arc is directed between two electric arc running rails, with an open magnetic circuit that includes a magnetic material and at least one permanent magnet for the delivery of a magnetic flux to the magnetic circuit, with the resulting generation of magnetic induction in the vicinity of the pre-chamber and acting upon the switching arc. In this exemplary magnet arrangement, the magnetic material is configured as a U-section sheet metal plate which extends along the length of the pre-chamber and is provided with a material recess which extends through this pre-chamber metal sheet and is arranged to contain the at least one permanent magnet.

By the configuration of the magnetic material as a pre-chamber metal sheet of appropriate shape, and by the arrangement of the at least one permanent magnet in a material recess in the pre-chamber metal sheet or casing, an easily-manufactured magnet arrangement can be achieved, which delivers the desired improvement in the running characteristics of the switching arc in the pre-chamber of a low-voltage circuit-breaker by the use of simple means. By the appropriate dimensioning of the material recess, the magnetic induction associated with the improvement of the running characteristics of the switching arc can also be adjusted with the greatest of ease.

The material recess may extend along a rear face which joins the two sides of the U-section plate. The material recess may be limited by a first web which connects the two sides of the U-section plate together. The material recess may also be limited by a second web which connects the two sides. The magnetic induction of the magnetic circuit acting in the pre-chamber may be adjusted by the variation of the geometrical dimensions of the first web.

Two pole faces of the at least one permanent magnet for the delivery of the magnetic flux to the pre-chamber metal sheet may be arranged to project from the material recess on both sides of the pre-chamber metal sheet.

The pre-chamber metal sheet (casing) may be secured to a pre-chamber insulation for the electrical isolation of the metal sheet from the switching arc, such as by a clip-on arrangement.

A marking may be applied to the pre-chamber metal sheet and/or to an exposed section of the surface of the pre-chamber insulation, indicating the associated pole of the at least one permanent magnet.

Two sides of the pre-chamber insulation, each associated with one of the two poles respectively of the at least one permanent magnet, may be provided with different coloration, such as the integral coloring of the material of the pre-chamber insulation.

The pre-chamber metal sheet and/or the pre-chamber insulation may be held in an assembly unit of the low-voltage circuit-breaker, such as by a plug-in arrangement.

The disclosure also relates to a low-voltage circuit-breaker with the above-mentioned magnet arrangement. If, in this circuit-breaker, the pre-chamber metal sheet is secured to a pre-chamber insulation for the electrical isolation of the sheet metal from the switching arc, and the pre-chamber metal sheet and the pre-chamber insulation are constituent elements of an assembly unit of the low-voltage circuit-breaker, the manufacture, servicing and modification of such a circuit-breaker will be straightforward, where the assembly unit is provided with a housing element which is arranged for attachment to a housing of the circuit-breaker, and is detachable from the circuit-breaker housing where specified.

The assembly unit may be incorporated into the circuit-breaker housing by means of a positive and frictional attachment of the housing element, such as by riveting, screw-fixing or pinning.

FIG. 1 shows an arc-extinguishing installation of a low-voltage circuit-breaker, incorporating a magnet arrangement in accordance with an exemplary embodiment of the present disclosure. The arc-extinguishing installation represented in FIG. 1 is arranged in an insulating housing 10, which is only partially represented, and its function is the extinction of two switching arcs (not represented) in a double-break, single- or multi-pole low-voltage circuit-breaker. The installation is configured in a substantially bilaterally symmetrical arrangement with respect to an electrically insulating partition 11 of the housing 10, and is provided with one breakpoint on both sides of the partition 11, each of which includes (e.g., is comprised of) one fixed and one moveable switching contact. Each of these two breakpoints cooperates with one of two pre-chambers by means of two electric arc running rails. Each pre-chamber has one of two arc chutes connected to it. The double-break circuit-breaker is shown in the open position. In FIG. 1, only the breakpoint 20 facing the viewer, with one fixed switching contact 21 and one moveable switching contact 22, is visible. Also represented is a pre-chamber 30, which cooperates with the fixed switching contact 21 of the breakpoint 20 via an electric arc running rail 31, and with the moveable switching contact 22 of the breakpoint 20 via an electric arc running rail 32, and the arc chute 40 which is connected to the pre-chamber 30 and contains the arc splitters 41.

With the circuit-breaker in the closed position, a first power terminal 51 of the circuit-breaker forms an electrically conductive connection with the second power terminal 55 thereof, specifically via the following components: a power conductor 52, a blow-out coil 53 of a short-circuit current trip device, a power conductor 54, the fixed switching contact 21, the moveable switching contact 22, arranged on one prong of a forked contact bridge 23, the contact bridge 23, the second non-visible breakpoint, a non-visible power conductor and an overcurrent trip device (not identified).

The pre-chamber 30, which can extend between the two electric arc running rails 31 and 32, is enclosed on both sides of the rails 31, 32, and from below, by a U-section pre-chamber insulation 60. A rear face 61 of the pre-chamber insulation 60 which connects the two sides 62 of the U-section sheet extends along the electric arc running rail 32 and bounds the pre-chamber 30 from below. The sides 62 formed by the shanks of the U-section pre-chamber insulation 60 extend along the electric arc running rails 31 and 32, and laterally bound the pre-chamber 30.

A pre-chamber metal sheet 70, also configured as a U-section sheet, is arranged on the side of the pre-chamber insulation 60 facing outwards from the interior of the pre-chamber 30, is formed of a magnetic material, such as soft iron or steel, and accommodates a permanent magnet 80 in a material recess 71 which is formed through the sheet metal. In an advantageous industrial process, the pre-chamber metal sheet 70 may be produced by die stamping from a flat sheet of magnetic sheet metal, then formed by plastic deformation of the resulting blanked or stamped part. It may be plugged into the pre-chamber insulation 60 or clipped onto the pre-chamber insulation 60, and secured by the snap-mounting or straddle-mounting of its elastically deformable sides 72 to the pre-chamber insulation 60.

Should a short-circuit current or overcurrent occur in a circuit leading from a voltage source to a consuming device via the power terminal 55, the enclosed arc-extinguishing installation and the power terminal 51, the two breakpoints 20 will open, as represented in FIG. 1, resulting in the generation of two switching arcs, which are not represented in FIG. 1. One of the two root points of the switching arc generated on the foremost breakpoint 20, facing the viewer, commutates from the fixed switching contact 21 to the upper electric arc running rail 31 and from the moveable switching contact 22 to the lower electric arc running rail 32 respectively. In response to self-generated magnetic forces, the switching arc travels along the rails 31, 32, through the pre-chamber 30 and into the arc chute 40, where it is cooled on the arc splitters 41, split into partial arcs and extinguished. The switching arc generated on the second breakpoint (not shown) behaves in a corresponding manner. Accordingly, the unwanted short-circuit current or overcurrent is interrupted by the extinction of both switching arcs.

Figure 2:
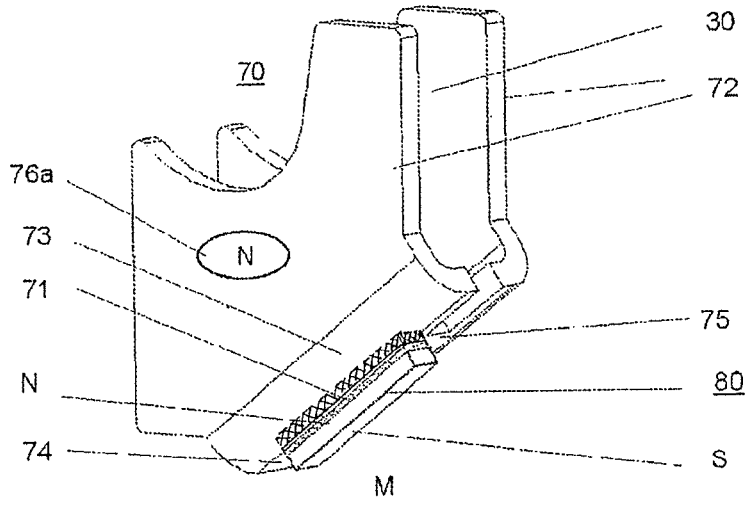
FIG. 2 shows a permanent magnet, and a pre-chamber metal sheet which holds said magnet, for the magnet arrangement represented in FIG. 1 in accordance with an exemplary embodiment of the present disclosure.
Figure 3:
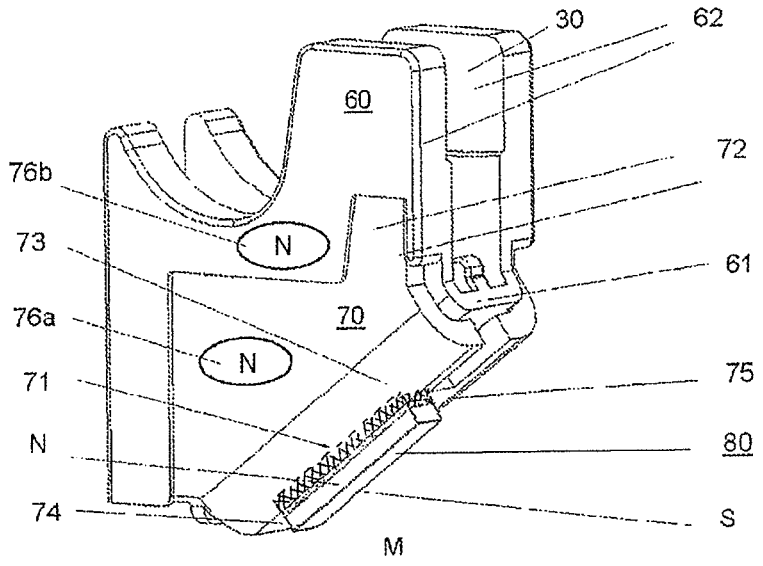
FIG. 3 shows a magnet arrangement after the fitting of the pre-chamber metal sheet holding the permanent magnet in accordance with FIG. 2 to a pre-chamber insulation of the arc-extinguishing installation in accordance with FIG. 1 in accordance with an exemplary embodiment of the present disclosure.

FIG. 2 shows a permanent magnet and a pre-chamber metal sheet which holds said magnet, for the magnet arrangement represented in FIG. 1 in accordance with an exemplary embodiment of the present disclosure. FIG. 3 shows a magnet arrangement after the fitting of the pre-chamber metal sheet holding the permanent magnet in accordance with FIG. 2 to a pre-chamber insulation of the arc-extinguishing installation in accordance with FIG. 1 in accordance with an exemplary embodiment of the present disclosure.

As shown in FIGS. 2 and 3, the pre-chamber metal sheet 70 and the permanent magnet 80 form a magnet arrangement M, represented in an enlarged form, which improves the running characteristics of the switching arc along the electric arc running rails 31, 32 in the pre-chamber 30 upon the interruption of a direct current, or of an alternating current with a superimposed direct current.

The magnet arrangement M is provided with an open magnetic circuit incorporating the pre-chamber metal sheet 70, into which the permanent magnet 80 delivers a magnetic flux. In an exemplary embodiment of the present disclosure, the material recess 71 can be configured in a rectangular form, and passes through a rear face 73 joining both sides or shanks 72 of the U-section sheet. The long sides of the rectangle run parallel to the rear face 73, thereby forming two comparatively large surfaces, via which the magnetic flux on the north pole N and on the south pole S (not visible here) respectively of the permanent magnet 80 is delivered to the pre-chamber metal sheet 70, which functions as an open magnetic circuit. A separate fixing device for the permanent magnet 80 is not called for, as the permanent magnet is maintained in a stable position in the material recess 71 by the magnetic flux carried in the magnetic circuit.

According to an exemplary embodiment described herein, two pole surfaces N and S of the permanent magnet 80 for the delivery of the magnetic flux to the pre-chamber metal sheet 70 project from the material recess 71 on both sides of the pre-chamber metal sheet 70. Accordingly, a strong magnetic flux can be achieved in the magnetic circuit, while maintaining a stable position of the permanent magnet 80 in the material recess 71. As the surfaces of the material recess 71, which is formed by the long sides of the rectangle and the pole faces N, S of the permanent magnet 80 being injected, can be beveled together in a virtually gapless arrangement, a comparatively high proportion of the magnetic flux from the permanent magnet is thus delivered to the magnetic circuit or pre-chamber metal sheet 70, respectively. The major proportion of the injected magnetic flux is routed to the shank 72 of the pre-chamber metal sheet 70 which acts as a magnetic pole, and delivers a comparatively high level of magnetic induction to the pre-chamber 30 arranged between the pole shanks 72 of the open magnetic circuit.

The action of magnetic induction in the pre-chamber 30 between the pole shanks 72 supports and accelerates the motion of the switching arc on the electric arc running rails 31, 32, even in the case of relatively low arcing currents and a correspondingly weak self-induced magnetic field.

The U-section sheet of the pre-chamber metal sheet 70 can be configured in virtually any geometrical form desired, provided that sufficient magnetic induction can be maintained in the running zone of the switching arc between the two pole shanks 72.

Magnetic induction between the two pole shanks 72 can be through the magnetic circuit being provided with a parallel connection. This parallel connection is achieved by the configuration of the two short sides of the rectangle bounding the material recess 71 in the form of webs 74 and 75 respectively. Where the permanent magnet 80 is fully magnetized, the induction between the two pole shanks 72 can be adjusted by means of the geometrical configuration of the two webs 74, 75. Accordingly, means is provided for the achievement of a defined magnetic induction in the pre-chamber 30.

In place of two webs 74, 75, a single web 75 alone may be provided for the connection of the two pole shanks 72 of the pre-chamber metal sheet 70. By the variation of the geometrical dimensions of the web 75, the magnetic induction acting in the pre-chamber 30 can also be optimized in this embodiment of the magnet arrangement M.

A marking 76*a* or 76*b* respectively may be applied to the pre-chamber metal sheet 70 or to an exposed section of the surface of the pre-chamber insulation 60 respectively, designating the associated pole N of the permanent magnet 80. This marking determines the direction of installation of the permanent magnet 80 and, accordingly, the polarization of the two pole shanks 72 too. The marking may be executed as desired and, in addition to letters, numerals or symbols may also include color marking. Color marking of this type may be achieved, in an advantageous manufacturing process, by the integral coloration of the material of the pre-chamber insulation 60. The markings 76*a* and/or 76*b* facilitate the installation and servicing of the magnet arrangement M.

Figure 4:
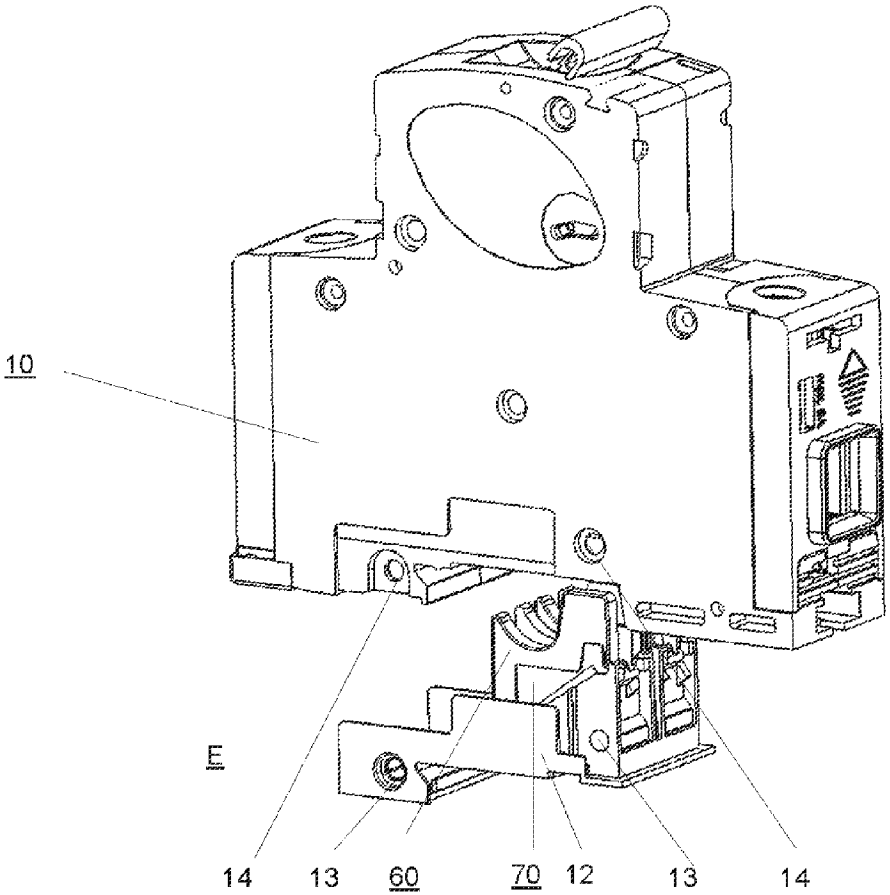
FIG. 4 shows an embodiment of the low-voltage circuit-breaker incorporating the arc-extinguishing installation in accordance with FIG. 1, in which the magnet arrangement according to the disclosure is arranged in an assembly unit of the circuit-breaker in accordance with an exemplary embodiment of the present disclosure.

FIG. 4 shows an embodiment of the low-voltage circuit-breaker incorporating the arc-extinguishing installation in accordance with FIG. 1, in which the magnet arrangement according to the disclosure is arranged in an assembly unit of the circuit-breaker in accordance with an exemplary embodiment of the present disclosure. As shown in FIG. 4, the pre-chamber metal sheet 70 and the pre-chamber insulation 60 are held in an assembly unit E of the low-voltage circuit-breaker. The assembly unit E is provided with a housing element 12 which is arranged for attachment to the circuit-breaker housing 10 and, where applicable, for detachment from the circuit-breaker housing 10. Bores 13 are formed in this housing element 12.

During the assembly or servicing of the circuit-breaker, the assembly unit E—as shown in FIG. 4—is inserted into the open base of the circuit-breaker housing 10. In the course of assembly, immediately the bores 14 formed in the circuit-breaker housing 10 are aligned with the bores 13, rivets are inserted into the bores 13, 14 and the parts 10 and 12 are riveted together, as a result of which the housing element 12, and consequently the assembly unit E too, are secured and incorporated in the circuit-breaker housing 10.

In an exemplary embodiment, alternative means of fixing which provide a positive and frictional attachment, such as screws or pins, may be used in place of rivets. The housing element 12 may also be secured to the circuit-breaker housing 10 by means of an elastically deformable connection. A connection of this type may be provided in the form of elastically deformable components of the housing element 12 and/or the circuit-breaker housing 10 which, upon fitting of the housing element 12, form a plug-in or snap-on connection respectively to the circuit-breaker housing 10, thereby incorporating the assembly unit E into the circuit-breaker.

The assembly unit E substantially facilitates the assembly and servicing of the low-voltage circuit-breaker, and also permits the field of application of the circuit-breaker to be varied by the application of simple means, such that the circuit-breaker will be capable of executing different switching functions with no significant expenditure.

In place of a single permanent magnet, the magnet arrangement M may also include two or more than two permanent magnets. For the achievement of a strong magnetic flux in the magnetic circuit, the permanent magnet may be provided in the form of a plate or a bar, but may also be configured as a horseshoe magnet, the contour of which matches the curvature of the rear face 73, and provided with pole faces N, S which deliver the magnetic flux directly to the shanks 72.

In another exemplary embodiment, the magnet arrangement M may also be incorporated in another form of low-voltage circuit-breaker, such as a motor circuit-breaker, rather than a low-voltage circuit-breaker. If the low-voltage circuit-breaker, as described, is provided with two breakpoints, two magnet arrangements according to the disclosure can be specified for the improvement of the running characteristics of the two switching arcs generated at the two breakpoints. However, if the low-voltage circuit-breaker is only provided with a single breakpoint, a single magnet arrangement according to the disclosure will be sufficient to improve the running characteristics of the single switching arc which is generated when the current is interrupted.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

LIST OF REFERENCES

10 Circuit-breaker housing
11 Partition
12 Element of circuit-breaker housing
13, 14 Bores
20 Breakpoint
21 Fixed switching contact
22 Moveable switching contact
23 Contact bridge
30 Pre-chamber
31, 32 Arc running rails
40 Arc chute
41 Arc splitters
51 Power terminal
52 Conductor
53 Blow-out coil
54 Conductor
55 Power terminal
60 Pre-chamber insulation
61 Rear face of pre-chamber insulation
62 Sides of pre-chamber insulation
70 Pre-chamber metal sheet
71 Material recess
72 Sides of pre-chamber metal sheet, pole shanks
73 Rear face of pre-chamber metal sheet
74, 75 Webs
76*a*, 76*b* Markings
80 Permanent magnet
N, S Magnetic poles, pole faces
E Assembly unit
M Magnet arrangement

What is claimed is:

1. A magnet arrangement for improving running characteristics of a switching arc generated upon an interruption of a current circuit in a pre-chamber of a low-voltage circuit-breaker, in which the switching arc is directed between two electric arc running rails, the magnet arrangement comprising:

an open magnetic circuit comprised of a magnetic material; and at least one permanent magnet that delivers a magnetic flux to the magnetic circuit and generates magnetic induction in a vicinity of the pre-chamber that acts upon the switching arc, wherein the magnetic material is configured as a U-section metal sheet which extends along the length of the pre-chamber, the U-section metal sheet including a material recess that extends through a pre-chamber metal sheet and contains the at least one permanent magnet.

2. The magnet arrangement as claimed in claim 1, wherein two pole faces of the at least one permanent magnet for delivery of the magnetic flux to the pre-chamber metal sheet are arranged to project from the material recess on both sides of the pre-chamber metal sheet.

3. The magnet arrangement as claimed in claim 1, wherein the material recess extends along a rear face which joins two shanks of the U-section metal sheet.

4. The magnet arrangement as claimed in claim 3, wherein two pole faces of the at least one permanent magnet for delivery of the magnetic flux to the pre-chamber metal sheet are arranged to project from the material recess on both sides of the pre-chamber metal sheet.

5. The magnet arrangement as claimed claim 3, wherein the pre-chamber metal sheet is secured to a pre-chamber insulation for the electrical isolation of the metal sheet from the switching arc.

6. The magnet arrangement as claimed in claim 3, wherein the material recess is limited by a first web which connects the two shanks of the U-section metal sheet together.

7. The magnet arrangement as claimed in claim 6, wherein the material recess is limited by a second web which connects the shanks of the U-section metal sheet.

8. The magnet arrangement as claimed in claim 7, wherein the magnetic induction of the magnetic circuit acting in the pre-chamber may be adjusted by variation of the geometrical dimensions of the first web.

9. The magnet arrangement as claimed in claim 6, wherein the magnetic induction of the magnetic circuit acting in the pre-chamber may be adjusted by variation of the geometrical dimensions of the first web.

10. The magnet arrangement as claimed in claim 6, wherein two pole faces of the at least one permanent magnet for delivery of the magnetic flux to the pre-chamber metal sheet are arranged to project from the material recess on both sides of the pre-chamber metal sheet.

11. The magnet arrangement as claimed claim 6, wherein the pre-chamber metal sheet is secured to a pre-chamber insulation for the electrical isolation of the metal sheet from the switching arc.

12. The magnet arrangement as claimed claim 1, wherein the pre-chamber metal sheet is secured to a pre-chamber insulation for the electrical isolation of the metal sheet from the switching arc.

13. The magnet arrangement as claimed in claim 12, wherein attachment of the pre-chamber metal sheet to the pre-chamber insulation is provided in the form of a clip-on or plug-in arrangement.

14. The magnet arrangement as claimed in claim 12, wherein the pre-chamber metal sheet includes a marking and an exposed section of the surface of the pre-chamber insulation, indicating the associated pole of the at least one permanent magnet.

15. The magnet arrangement as claimed in claim 12, wherein the pre-chamber insulation has two sides, each side is associated with one of the two poles respectively of the at least one permanent magnet, and are provided with different coloration established by an integral coloring of a material of the pre-chamber insulation.

16. The magnet arrangement as claimed in claim 12, wherein the pre-chamber metal sheet and the pre-chamber insulation are held in an assembly unit of the low-voltage circuit-breaker.

17. The magnet arrangement as claimed in claim 16, wherein the pre-chamber metal sheet and the pre-chamber insulation are held in the assembly unit by a plug-in arrangement.

18. A low-voltage circuit-breaker comprising:

a pre-chamber;

electric arc running rails, wherein a switching arc is directed between two of the electric arc running rails; and a magnet arrangement, wherein the magnet arrangement comprises:

an open magnetic circuit comprised of a magnetic material; and at least one permanent magnet that delivers a magnetic flux to the magnetic circuit and generates magnetic induction in a vicinity of the pre-chamber that acts upon the switching arc, wherein the magnetic material is configured as a U-section metal sheet which extends along the length of the pre-chamber, the U-section metal sheet including a material recess that extends through a pre-chamber metal sheet and contains the at least one permanent magnet.

19. The circuit-breaker as claimed in claim 18, in which the pre-chamber metal sheet is secured to a pre-chamber insulation for electrical isolation of the metal sheet from the switching arc, and the pre-chamber metal sheet and the pre-chamber insulation are constituent elements of an assembly unit of the circuit-breaker, wherein the assembly unit includes a housing element configured to be attached to a housing of the circuit-breaker and detachable from the circuit-breaker housing.

20. The circuit-breaker as claimed in claim 19, wherein the assembly unit is incorporated into the circuit-breaker housing by means of a positive and frictional attachment of the housing element.

21. The circuit breaker as claimed in claim 20, wherein the housing element is attached through at least one of riveting, screw fixing, or pinning.

* * * * *